United States Patent [19]

Schrewe

[11] Patent Number: 4,955,428

[45] Date of Patent: Sep. 11, 1990

[54] DEVICE FOR CONTINUOUS CASTING OF SLABS

[75] Inventor: Hans Schrewe, Duesseldorf, Fed. Rep. of Germany

[73] Assignee: Mannesmann AG, Duesseldorf, Fed. Rep. of Germany

[21] Appl. No.: 331,530

[22] PCT Filed: Aug. 17, 1987

[86] PCT No.: PCT/DE87/00370

§ 371 Date: Feb. 21, 1989

§ 102(e) Date: Feb. 21, 1989

[87] PCT Pub. No.: WO88/01209

PCT Pub. Date: Feb. 25, 1988

[30] Foreign Application Priority Data

Aug. 18, 1986 [DE] Fed. Rep. of Germany ..... 3627991

[51] Int. Cl.[5] ..... B22D 11/04; B22D 11/12

[52] U.S. Cl. ..... 164/417; 164/418; 164/424; 164/442

[58] Field of Search ..... 164/418, 417, 459, 476, 164/442, 424

[56] References Cited

U.S. PATENT DOCUMENTS

| | | | |
|---|---|---|---|
| 3,974,559 | 8/1976 | Kawawa et al. | 164/76.1 |
| 4,493,363 | 1/1985 | Fredriksson et al. | 164/476 |
| 4,635,702 | 1/1987 | Kolakowski et al. | 164/418 |
| 4,716,955 | 1/1988 | Fastert | 164/418 X |

FOREIGN PATENT DOCUMENTS

| | | | |
|---|---|---|---|
| 0179364 | 4/1986 | European Pat. Off. | 164/459 |
| 793704 | 1/1981 | U.S.S.R. | 164/418 |
| 910331 | 3/1982 | U.S.S.R. | 164/442 |
| 1199805 | 7/1970 | United Kingdom . | |

*Primary Examiner*—Richard K. Seidel
*Assistant Examiner*—J. Reed Batten, Jr.
*Attorney, Agent, or Firm*—Ralf H. Siegemund

[57] ABSTRACT

An apparatus for continuous casting of slabs having a considerably larger width than thickness, particularly of steel slabs with a thickness below 80 mm, includes feeding the molten material to a mold from a casting vessel, the mold having a cross-section at its charge and power inside, deviating in the middle portion from the desired casting format by a large cross-section but matches the desired format near the edges. In order to obtain an objective for providing equipment for making steel slabs with thickness below 80 mm, without defects and with a high surface quality, its is suggested that, while maintaining the cross-sectional contour of the charge and pour-in end of the mold, over the entire mold length, the skin of the emerging casting in its middle portion is deformed by directly downstream arranged guide and support structure such that after passage through the deforming path the surfaces of the entire slab coincide with the initial edge zone surfaces.

2 Claims, 4 Drawing Sheets

DEVICE FOR CONTINUOUS CASTING OF SLABS

The present invention relates to a device for the continuous casting of slabs which have a considerable larger width than thickness, particularly of steel slabs with a thickness below 80 mm, whereby molten material is poured from a casting vessel into a mold, having a charge and pour-in cross-section, whose middle portion deviates from the desired casting contour in a cross-section increasing fashion, but corresponding to the desired casting format in the edge zone, and whereby maintaining the cross-sectional format at the charge and pour-in side of the mold is maintained over the entire mold length, and the casting skin as emerging from the mold is to be deformed in the middle portion, by means of guide and support means arranged directly downstream from the mold such that following passage through the deforming path, the surfaces of the entire casting are situated in the surfaces of coinciding with the edge zone.

A mold for continuous casting of this kind is known from British Patent No. A 1,199,805, whereby not only the crosssectional contour, but the cross-section itself, remains uniform from the entrance and charge end to the exit and discharge end of the mold. The final contour of the crosssection of the continuous casting is formed exclusively through rolls which are arranged downstream from the mold.

European Patent No. A 0,149,734, which corresponds to German Patent No. 3,400,220, moreover, makes known a mold for continuous casting of steel strip, wherein the wide sides form an upper funnel shaped pour-in and charge zone.

This mold has the disadvantage that in the transition from a cross-section increasing pour-in zone, to the desired form and format of the continuous casting strong bending forces are exerted upon the skin of the casting within the mold. For reducing the wear resulting from this bending, it is necessary to maintain small the deforming angle alpha, while, in addition, the casting speed and the cooling speed have to be selected within tight limits in order to make sure that the skin can be moved out of the mold without formation of cracks. Molds configured in this fashion exhibit a strong friction in the transition zone which friction can be reduced only to a relatively small extent by means of known lubrication. The known mold, moreover, has the additional disadvantage that upon maintaining a small deforming angle alpha, preferably smaller than 10°, the mold has to be made the longer the thinner the slab is supposed to be.

It is an object of the present invention to provide a method and equipment such that steel slabs with a thickness below 80 mm can be manufactured without defects and with a high surface quality.

The object is attained in accordance with the invention by operation of the features which include the following cross-section in the middle portion of the casting is uniformly bulged, but is smaller on the discharge at exit from the mold, as compared with a larger bulge cross-section at the pour-in and charge side, and that lines of transition from the plane slab surface to the bulge surface has a conicity in longitudinal direction matching the cross-sectional and conicity increase of the bulging portion, but to be not more than 1.2%, that the spacing and distance from the outer periphery 18 of a casting pipe and spout, and the apex point of the bulge at the pour-in and charge side in the surface level of the molten material is at least 20 mm; that at least one roll of at least one pair of rolls of the guide and support means downstream from the mold is provided with sizing dimension matching the emerging casting; and that the distance between the rolls of a roller pair from roller pair to roller pair reduces in the direction of casting by at least 0.5 mm, but not more than 25 mm, such that the deformation at the front of solidification does not exceed a value of 0.5%.

The degree of bulging is selected in accordance with the invention such that in dependance upon the outer diameter of the casting spout and pipes, as used in the mold, it has a minimum distance of 30 mm to the apex point of the bulge on the entrance and charge side, the distance being taken in the level of the casting liquid in the mold. The lines of transition in the mold concerning the bulge, to this part of the mold running in the plane of the slab surface is conically configured. The conicity is matched in longitudinal direction to the cross-sectional increase of the bulging zone, but is never more than 1.2%.

The supporting guide means which are arranged downstream from the mold, are characterized in accordance with the invention in that at least one roll, of at least one pair of rolls, is configured for sizing in a manner matched to the contour of the casting that emerges from the mold. Individual rolls may have a cylindrical, conical, or a bulging configuration. They are resiliently suspended in a guide frame and hydraulically adjustable transversely to the axis of casting. In order to make sure that the cold start-up casting can pass through the casting deforming path without interference, one will use a known electronic track or path control for the adjustment of the rolls.

The desired deforming of the casting, as emerging from the mold, is provided in accordance with the invention such that the distance between two rolls of a pair of rolls is reduced from roller pair to roller pair in the direction of casting by a value amounting to at least one half millimeter but not more than 25 millimeters. The range of width adjusting of the rollers is required so that one can take into consideration requirements which are specific to the material used, as well as requirements and conditions on the dimension in order to make sure that the product remains crack free. Reducing the bulge of the emerging casting format providing for the increase in cross-section, drawn to the flatness of the desired and final cross-sectional format of the casting, is preferably distributed over a total length of about at least 1½ meters such that only after the casting has left the deforming portion of the casting withdrawal path the cross-section of the casting will be completely solidified, whereby this minimal value of 1.5 m is associated with a distance reduction as between the rolls of the adjacent pair of 25 mm. The rolls, establishing the size, may be individually driven.

The drawing illustrates an example of the invention, wherein FIG. 1 is a longitudinal section through the equipment for continuous casting;

Figure 1:
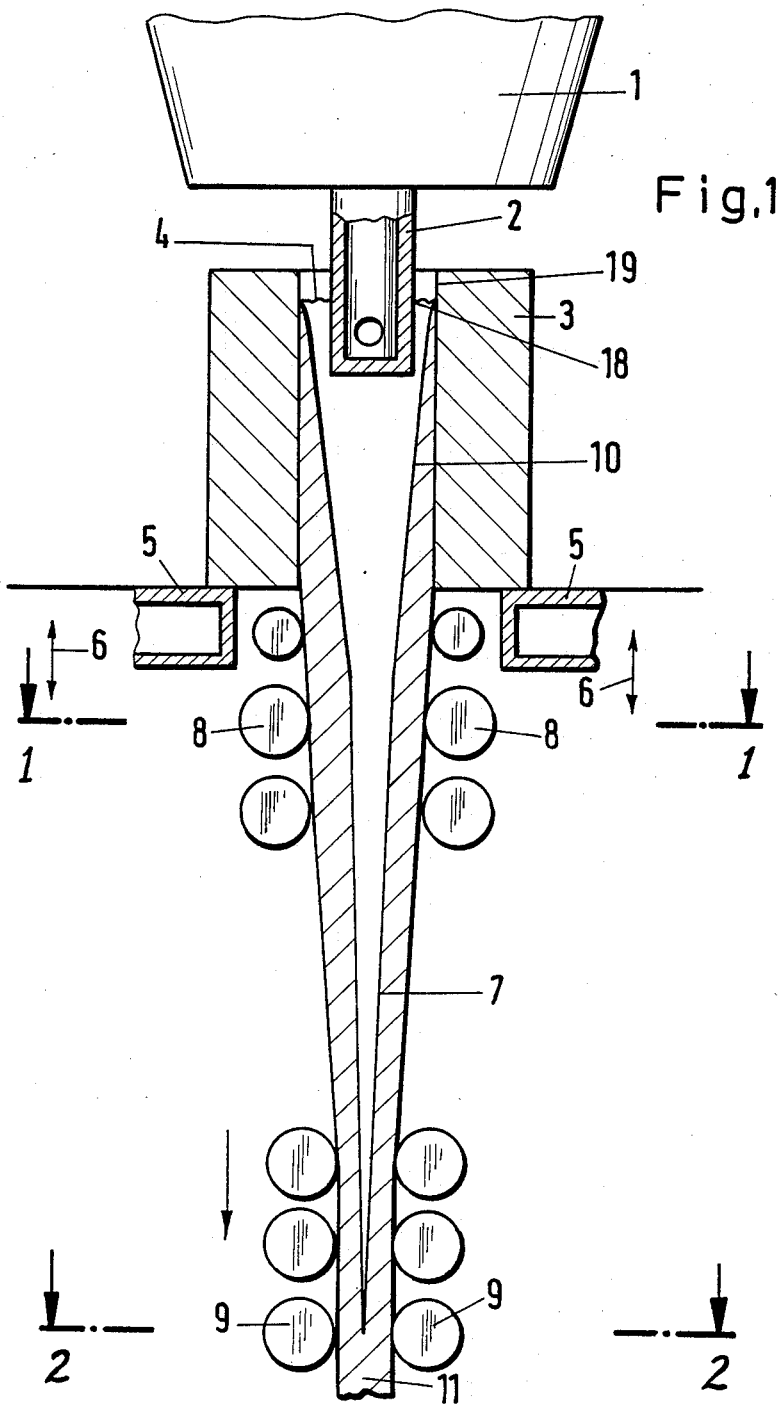
Figure 4:
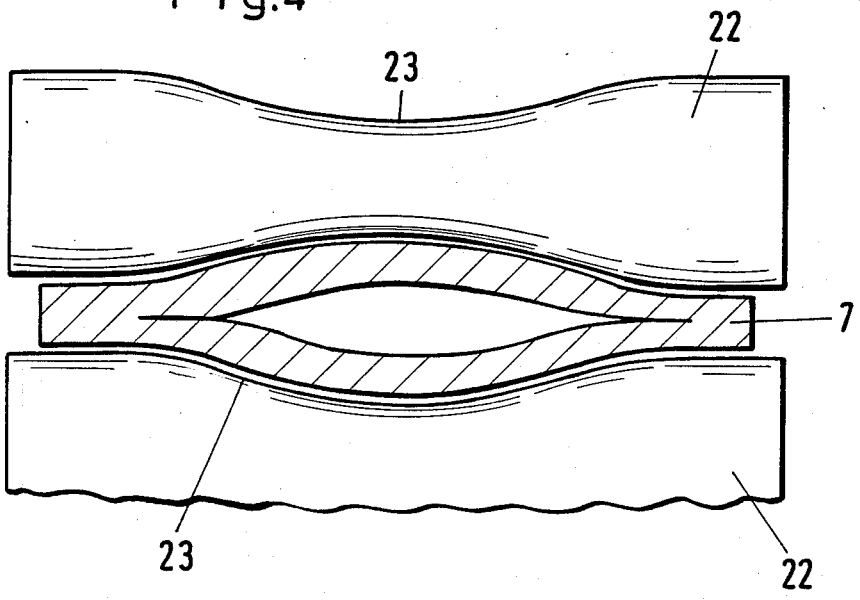
Figure 5:
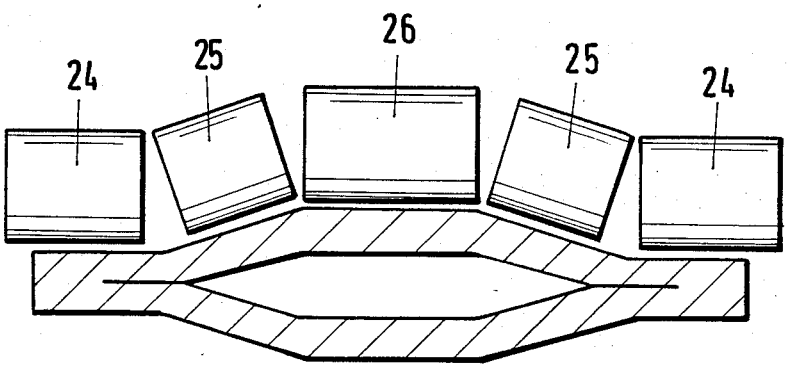
Figure 6:
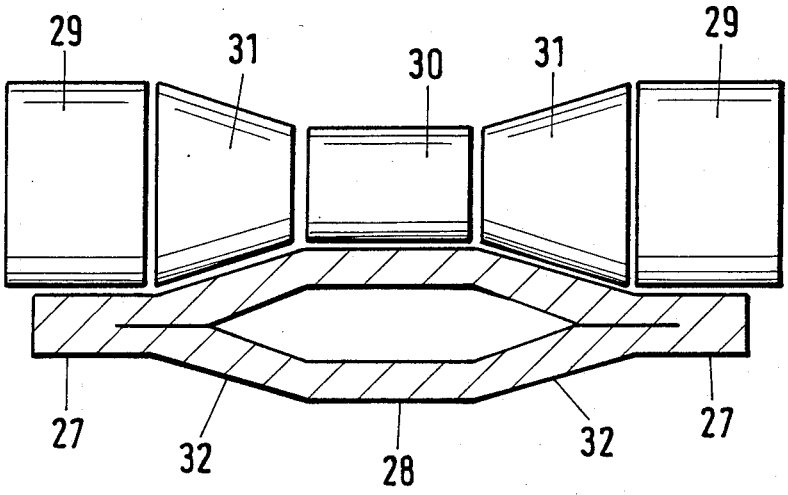
Figure 7:
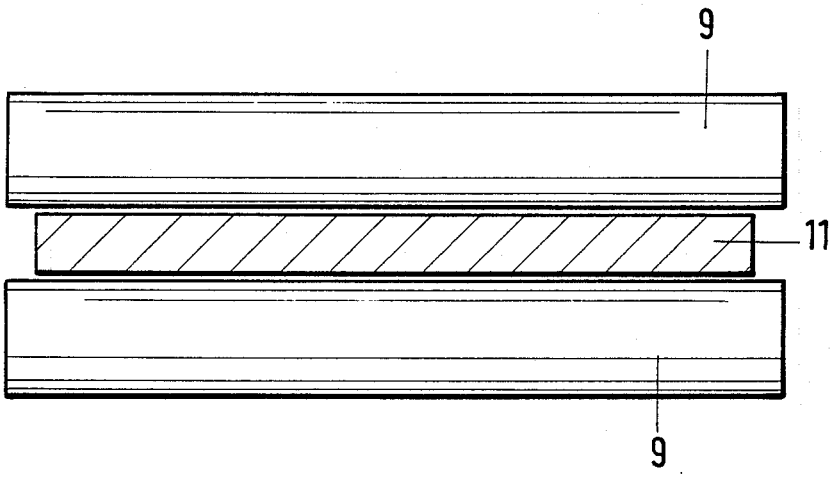

FIGS. 4, 5, and 6 show different configurations of the rolls, establishing the final dimension of the casting, the sections being taken along the line 1—1 in FIG. 1, particularly within the zone of deformation; and FIG. 7 is a cross-section through the casting taken along the line 2—2 in FIG. 1.

FIG. 1 illustrates a longitudinal section through the inventive equipment for continuous casting of slabs with a considerable larger width than thickness, particularly steel slabs, with a thickness of below 80 mm, whereby the molten material is poured from a casting container 1 through a casting spout and pipe 2, dipping into the bath 4, the molten material being fed to this mold 3. The mold 3 is fastened to a frame 5 and may oscillate in the direction of casting, as indicated by the arrows 6. The casting 7, having a format as illustrated, and emerging from the mold 3, is deformed in accordance with the invention through downstream arranged support and guide means 8 of the casting such that the central portion of the skin 10 is situated in the plane of the casting surface of the edge zone 11.

Figure 2:
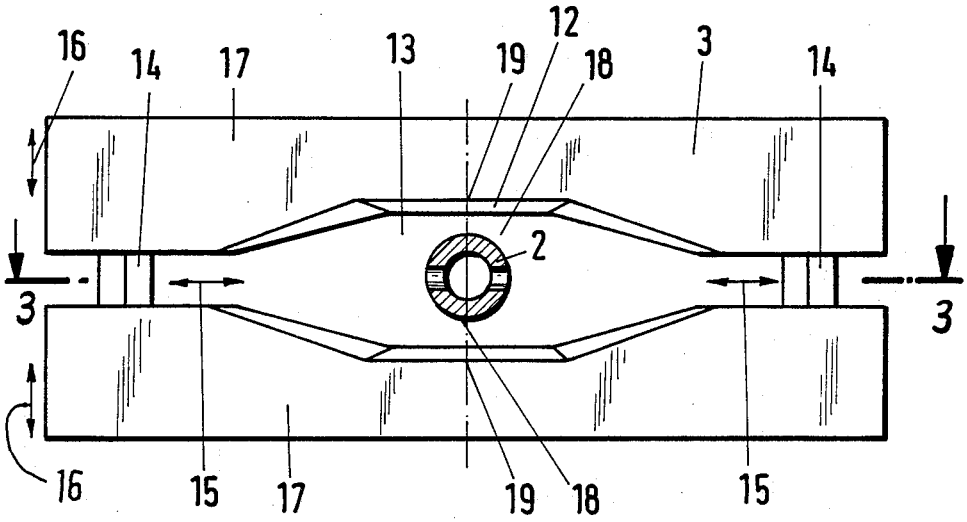
FIG. 2 is a top view of the mold for slabs with a thickness of below 80 mm.
Figure 3:
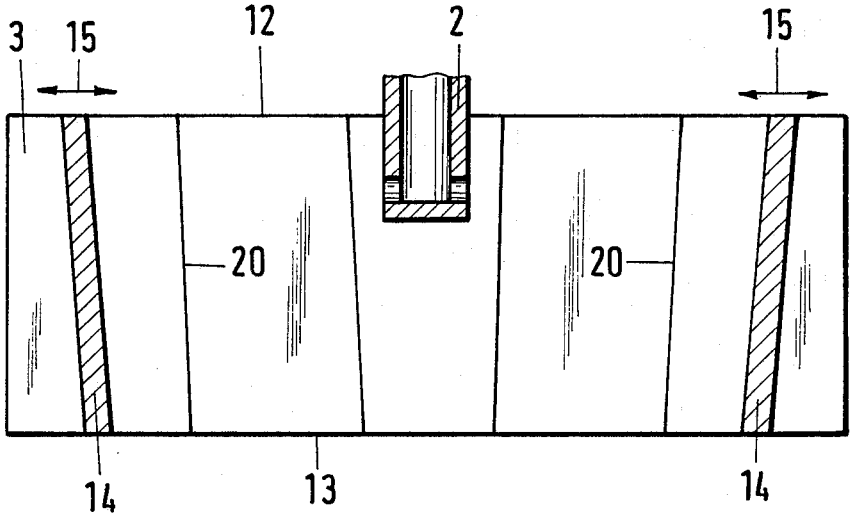
FIG. 3 illustrates a section through the empty mold along the line 3—3 of FIG. 2.

As seen in top view, the mold 3 shown in FIG. 2, establishes in accordance with the invention the outwardly bulging cross-sections 12 and 13 establish in their middle portion, taken in conjunction with small side walls 14 corresponding to the desired casting format the mold cavity proper as between charge inlet and discharge outlet. The arrows 15 and 16 are supposed to indicate that the longitudinal side walls 14, as well as the width defining side wall 17, are slidable, so that the desired crosssection 7 can be adjusted in a variable fashion.

The dimension of the used casting pipe and spout 2 are related to the cross-section increasing bulge 12 in the middle portion on the charge side of pour in such that in the surface level of the bath 4 of the molten casting material there is a minimum distance between the outer periphery 18 of the casting spout and pipe 2, and the apex point of the bulge 19, amounting to 20 mm, and that distance is being maintained. The longitudinal section through the mold 3 along the line 3—3 in FIG. 2 illustrates that the line 20 of the transition of the bulge, to the part situated in the plane of the slab surface, runs conically, whereby, in accordance with the invention, the value of the conicity remains below 1.2%. Tee longitudinal side walls 14 are likewise conically adjusted, whereby through known spindles with different pitch, the desired conicity is adjusted in dependence upon the width of the casting taken together with the longitudinal shift 15.

Different configurations of the sizing roller pairs 8 of the roller path are shown in FIGS. 4, 5, and 6, particularly in the zone of deformation. In FIG. 4 matching of the rolls 8 to the emerging casting 7 is obtained in that two rollers 22, establishing a roller pair, have a concavely format sizing contour 23. In a second example of FIG. 5, cylindrically contoured individual rolls 24, 25, and 26 approximate as a group the desired size necessary for deforming the cross-section of the casting. A third configuration is illustrated in FIG. 6, whereby the surfaces 27 and 28, running parallel to the longitudinal plane of the casting, are provided through the cylindrical rollers 29 and 30, while conically contoured rollers 31 are used for obtaining the transition surfaces 32. In this embodiment the rollers 29 to 31, establishing the size of the casting, are situated on a common axis.

All of the individual rollers 22 through 26, and 29 through 31 provided for working in the respective deformation zone, in all three embodiments, are preferably resiliently suspended, and hydraulically adabtable. Matching the bulging cross-section 13 in the middle portion of the emerging casting to that of the desired casting format of the original edge zones 11, is shown in FIG. 7. The guiding of the casting 11, being completely solidified at this point, is taken over by straight-through cylindrically contoured rollers 9.

I claim:

1. Apparatus for continuous casting of slabs with considerably larger width than thickness, particularly of steel slabs with a thickness below 80 mm, including a casting pipe and spout for pouring molten material from a casting vessel into a mold, the mold having a charge and pour-in cross-section, whose middle portion deviates from the desired casting contour in a cross-section increasing fashion, the edge zones of the mold corresponding to the desired casting format the cross-sectional format at the charge and pour-in end of the mold is maintained over the entire mold length, and the casting skin as emerging from the mold is to be deformed in the middle portion by means of guide and support means being arranged directly downstream from the mold such that following passage through the deforming path, the surfaces of the entire casting are situated in the surfaces of the edge zone; the improvement comprising:

the cross-section of the mold in the middle portion of the casting being outwardly uniformly bulged, but a bulge being smaller in a discharge and exit end from the mold, as compared with a larger bulge cross-section at the pour-in and charge end whereby geometric lines delineating a transition from the plane slab surface of the mold to the bulging surface of the mold has a downwardly oriented narrowing tapering and conicity in longitudinal direction matching a cross-sectional and conicity increase of the bulging portion, but to be not more than 1.2%, a spacing and distance from an outer periphery of the casting pipe and spout and an apex point of said bulge at the pour-in and charge end in a surface level of the molten material is at least 20 mm;

at least one roll of at least one pair of rolls of the guide and support means downstream from the mold being provided with sizing dimension matching an emerging casting; and a distance between the rolls of a roller pair from roller pair to roller pair reduces in the direction of casting by at least 0.5 mm, but not more than 25 mm, such that any deformation at the front of solidification does not exceed a value of 0.5%.

2. Apparatus as in claim 1, characterized in that at least one of the roller pairs establishing the sizing is provided with its own drive.

* * * * *